US009926821B2

(12) United States Patent
Yamada et al.

(10) Patent No.: US 9,926,821 B2
(45) Date of Patent: Mar. 27, 2018

(54) CYLINDER LUBRICATION SYSTEM FOR TWO-STROKE ENGINE

(71) Applicant: HONDA MOTOR CO., LTD., Tokyo (JP)

(72) Inventors: Yoshikazu Yamada, Saitama (JP); Mashu Kurata, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 118 days.

(21) Appl. No.: 14/514,520

(22) Filed: Oct. 15, 2014

(65) Prior Publication Data

US 2015/0184563 A1 Jul. 2, 2015

(30) Foreign Application Priority Data

Dec. 27, 2013 (JP) ..... 2013-271037

(51) Int. Cl.
*F01M 11/02* (2006.01)
*F01M 1/02* (2006.01)
(Continued)

(52) U.S. Cl.
CPC ..... *F01M 11/02* (2013.01); *F01L 1/06* (2013.01); *F01L 1/08* (2013.01); *F01L 1/10* (2013.01);
(Continued)

(58) Field of Classification Search
CPC . F01M 1/06; F01M 1/08; F01M 11/02; F01M 2001/083; F01M 2011/022;
(Continued)

(56) References Cited

U.S. PATENT DOCUMENTS 4,280,455 A * 7/1981 Yamaguchi ..... F01M 1/08 123/196 M
5,570,668 A * 11/1996 Hsu ..... F01M 1/08 123/193.2
(Continued)

FOREIGN PATENT DOCUMENTS

JP 54117844 A * 9/1979 ..... F01M 1/06
JP 55025684 U * 2/1980 ..... F02F 3/00
(Continued)

OTHER PUBLICATIONS

English machine translation from IP.com of JP 2979007.*
(Continued)

*Primary Examiner* — Jacob Amick
*Assistant Examiner* — Michael A Kessler
(74) *Attorney, Agent, or Firm* — Westerman, Hattori, Daniels & Adrian, LLP

(57) ABSTRACT

In a cylinder lubrication system for a two-stroke engine, a plurality of lubricating oil supply openings (78) open out in the inner circumferential surface of the cylinder (42) at a point lower than a top ring (22*b*) of a piston (22) located at a bottom dead center. The lubricating oil supply openings are configured to provide a larger amount of lubricating oil in the thrust side and anti-thrust side of the cylinder than in a remaining part of the cylinder. Thereby, the consumption of lubricating oil and the emission of undesired substances can be minimized while providing an optimum lubrication of the sliding part between the piston and the cylinder.

7 Claims, 10 Drawing Sheets

(51) Int. Cl.

| | |
|---|---|
| ***F02F 7/00*** | (2006.01) |
| ***F01L 1/06*** | (2006.01) |
| ***F01L 1/08*** | (2006.01) |
| ***F01L 1/10*** | (2006.01) |
| ***F01L 1/12*** | (2006.01) |
| ***F01L 1/14*** | (2006.01) |
| ***F01L 1/18*** | (2006.01) |
| ***F01L 3/20*** | (2006.01) |
| ***F01M 1/08*** | (2006.01) |
| *F02F 1/22* | (2006.01) |
| *F02F 1/20* | (2006.01) |
| *F02B 75/32* | (2006.01) |
| *F02B 75/02* | (2006.01) |

(52) U.S. Cl.
CPC ..... *F01L 1/12* (2013.01); *F01L 1/146* (2013.01); *F01L 1/18* (2013.01); *F01L 3/205* (2013.01); *F01M 1/02* (2013.01); *F01M 1/08* (2013.01); *F02F 7/0036* (2013.01); *F01L 2105/00* (2013.01); *F01M 2001/083* (2013.01); *F01M 2011/022* (2013.01); *F02B 75/32* (2013.01); *F02B 2075/025* (2013.01); *F02F 1/20* (2013.01); *F02F 1/22* (2013.01)

(58) Field of Classification Search
CPC ..... F01M 3/04; F02F 1/20; F02F 1/22; F02F 7/0036; F01B 11/00; F01B 11/02
USPC ..... 184/6.8; 123/196 R, 196 M
See application file for complete search history.

(56) References Cited

U.S. PATENT DOCUMENTS

| | | | | |
|---|---|---|---|---|
| 6,581,563 | B2 | 6/2003 | Uneta | |
| 7,104,240 | B1 * | 9/2006 | Vuk | F02F 1/20 123/193.2 |
| 7,685,991 | B2 * | 3/2010 | Cumming | F02F 1/20 123/305 |
| 9,695,738 | B2 * | 7/2017 | Kurata | F02F 1/22 |
| 2002/0011231 | A1 | 1/2002 | Uneta | |
| 2009/0013866 | A1 * | 1/2009 | Kariya | F16J 9/068 92/172 |

FOREIGN PATENT DOCUMENTS

| | | | | |
|---|---|---|---|---|
| JP | 62067261 | A * | 3/1987 | F16J 1/08 |
| JP | 2979007 | B2 * | 11/1999 | F01M 1/06 |
| JP | 2002-081305 | A | 3/2002 | |
| JP | 2002-529648 | A | 9/2002 | |
| JP | 2003-286816 | A | 10/2003 | |
| JP | 2004-144014 | A | 5/2004 | |

OTHER PUBLICATIONS

English machine translation of JP 55025684 U.*
Human Translation of JP 55-025684 U.*
Japanese Office Action dated Jul. 19, 2016, issued in corresponding Japanese Patent Application No. 2013-271037, with English translation.

* cited by examiner

CYLINDER LUBRICATION SYSTEM FOR TWO-STROKE ENGINE

TECHNICAL FIELD

The present invention relates to a cylinder lubrication system for a two-stroke engine, and in particular to a cylinder lubrication system for lubricating between a piston and a cylinder wall by feeding lubricating oil to the cylinder wall from an external lubricating oil source.

BACKGROUND OF THE INVENTION

In a two-stroke engine, the crankcase is enclosed in an air-tight manner so that the intake may be drawn into the crankcase owing to the negative pressure therein created by the upward stroke of the piston, and the air or mixture in the crankcase is compressed by the downward stroke of the piston to be fed into the combustion chamber via a scavenging port which opens up at a certain point of the downward stroke of the piston. Therefore, the splash lubrication which is achieved by the splashing of the lubricating oil received in the crankcase cannot be used, and it is customary to use fuel mixed with two-stroke oil to achieve the required lubrication of the engine.

When the lubrication of the engine relies on the oil mixed in the fuel, the lubricating oil inevitably burns with the fuel so that not only the running cost of the engine is high owing to the high consumption of oil but also undesired emissions increase. External lubrication systems using special piping to feed lubricating oil into the engine from an external source are also known, but in the case of a two-stroke engine involving a crankcase compression, as the lubricating oil that has lubricated by the cylinder inner wall drops into the crankcase to be stirred up by the crank throw and the connecting rod, a significant part of the lubricating oil travels into the combustion chamber to be burnt therein. Therefore, as compared to the engines that are provided with a proper intake valves actuated by a valve actuating mechanism, there still remains the problems of a high lubricating oil consumption and a poor emission property.

As a technology for reducing the consumption of lubricating oil in two-stroke engines using an external source for lubricating the cylinder wall, it is known to provide an oil retaining groove that communicates with each of the oil feed holes opening out in the cylinder wall and extends obliquely in the direction of the scavenging flow swirl. See JP2003-286816A.

As a technology for favorably dispersing lubricating oil on the cylinder wall surface in two-stroke engines for distributing lubricating oil drawn from an external source over the cylinder wall surface, it is known to apply a jet of atomized lubricating oil via a nozzle onto the cylinder wall surface immediately before the piston passes by. See JP2002-529648A.

These prior proposals allow the sliding parts of the piston and the cylinder to be lubricated while reducing the consumption of lubricating oil and undesirable emission. However, in either case, the lubricating oil has to be ejected by using a special oil ejection device at an appropriate timing so that a relatively complex oil feeding system is required, and the manufacturing cost increases Therefore, there is a demand for a lubrication system for small two-stroke engines that is more simple in structure.

SUMMARY OF THE INVENTION

In view of such problems of the prior art, a primary object of the present invention is to provide a cylinder lubrication system for a two-stroke engine which can minimize the consumption of lubricating oil and the emission of undesired substances.

A second object of the present invention is to provide a cylinder lubrication system for a two-stroke engine which is highly simple in structure, but can achieve a favorable lubrication of the cylinder.

To achieve such objects, the present invention provides a cylinder lubrication system for a two-stroke engine including a scavenging port opening out in an inner circumferential surface of a cylinder, comprising: a lubricating oil supply passage defined in an engine main body and connected to a lubricating oil source; and a plurality of lubricating oil supply openings opening out in the inner circumferential surface of the cylinder at a point lower than a top ring of a piston located at a bottom dead center; wherein the lubricating oil supply openings are configured to provide a larger amount of lubricating oil in at least one of a thrust side and an anti-thrust side of the cylinder than in a remaining part of the cylinder.

Thereby, lubricating oil can be supplied to the sliding part between the piston and the cylinder at a proper timing without requiring special oil injection system. In particular, lubricating oil can be supplied to the part that particularly requires lubrication such as a thrust side and an anti-thrust side of the cylinder with an adequate amount without wastefully lubricating other parts of the cylinder, the use efficiency of the lubricating oil can be improved.

Preferably, the lubricating oil supply openings open out in the inner circumferential surface of the cylinder at a point higher than an oil ring of the piston located at a bottom dead center.

Thereby, the lubricating oil supplied from the lubricating oil supply openings can be scraped upward during the upward stroke of the piston so that the lubrication of the sliding part between the piston and the cylinder when the piston is near the top dead center can be performed in a favorable manner.

According to a preferred embodiment of the present invention, the lubricating oil supply openings are arranged circumferentially at a regular interval, those lubricating oil supply openings located on the thrust side and anti-thrust side being greater in diameter than the remaining lubricating oil supply openings.

Thus, the lubricating oil can be preferentially supplied to the thrust side and anti-thrust side of the cylinder by using a simple structure.

According to another preferred embodiment of the present invention, the lubricating oil supply openings are arranged circumferentially, and provided with a same diameter, those lubricating oil supply openings located on the thrust side and anti-thrust side being arranged denser than the remaining lubricating oil supply openings.

In this case also, the lubricating oil can be preferentially supplied to the thrust side and anti-thrust side of the cylinder by using a simple structure.

According to a particularly preferred embodiment of the present invention, the engine main body comprises a cylinder block and a cylinder sleeve fitted in the cylinder block and including a lower end projecting from the cylinder block into a crank chamber, the lubricating oil supply openings being formed in the cylinder sleeve; wherein an annular oil passage forming member surrounds a part of an outer circumferential surface of the cylinder sleeve corresponding to the lubricating oil supply openings, and an annular groove is formed in an inner circumferential surface of the oil passage forming member so as to commonly communicate with the lubricating oil supply openings.

According to this arrangement, an annular oil passage for distributing lubricating oil to the lubricating oil supply openings can be formed simply by installing the annular oil passage forming member which is formed with a groove on the inner circumferential surface thereof around the lower part of the cylinder sleeve. This oil passage is connected to an oil source such as an oil pump so that the lubricating oil may be distributed to the lubricating oil supply openings.

Preferably, an interface between the annular oil passage forming member and the cylinder sleeve is sealed by seal members, both above and below the annular groove.

Thereby, the sealing of the oil passage defined by the annular groove can be achieved in a both simple and reliable manner.

BRIEF DESCRIPTION OF THE DRAWINGS

Now the present invention is described in the following with reference to the appended drawings, in which.

DESCRIPTION OF THE PREFERRED EMBODIMENT(S)

The present invention is described in the following with respect to a uni-flow type, single cylinder, two-stroke engine (engine E).

Figure 1:
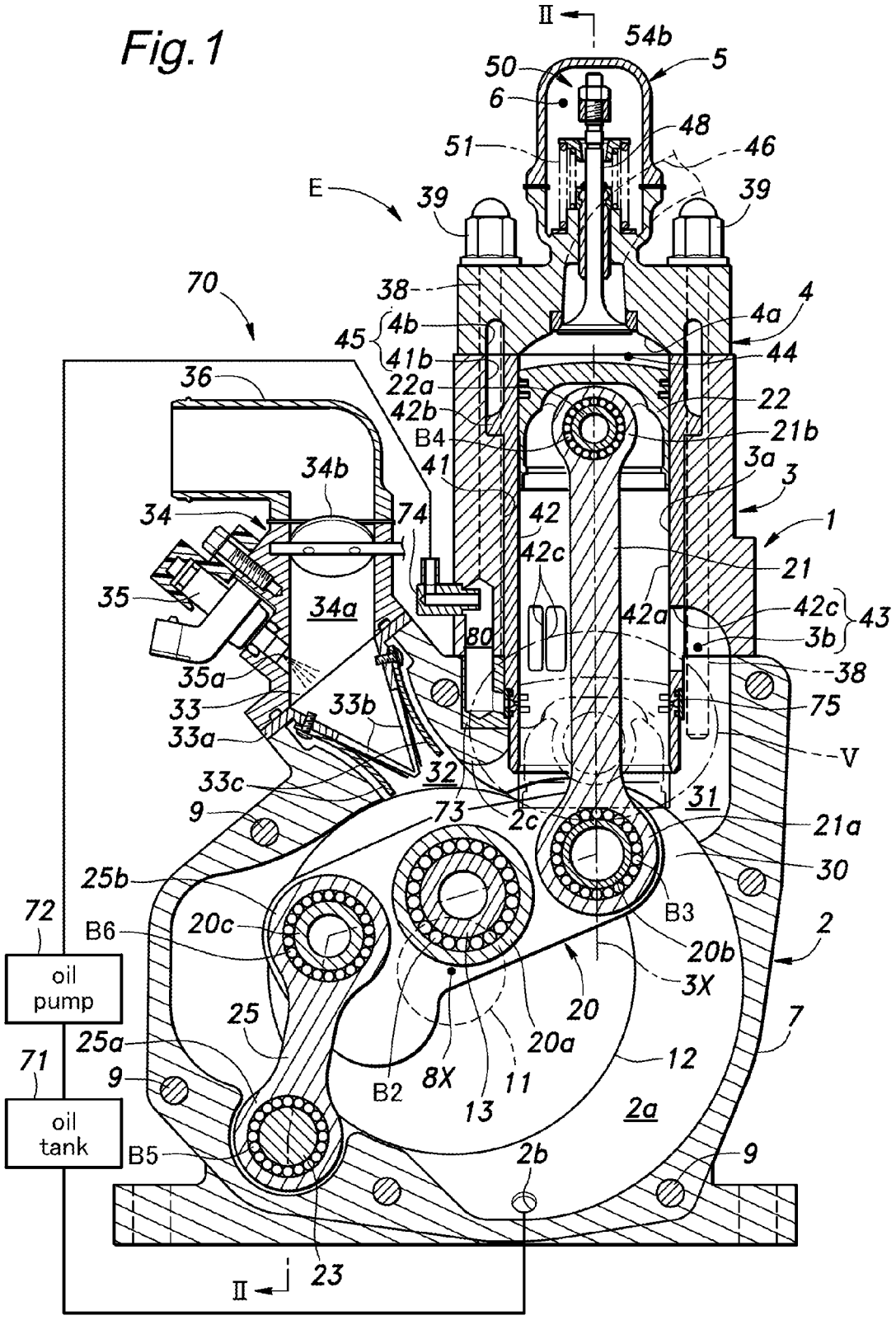
FIG. 1 is a vertical sectional view of an engine embodying the present invention (taken along line I-I of FIG. 2)
Figure 2:
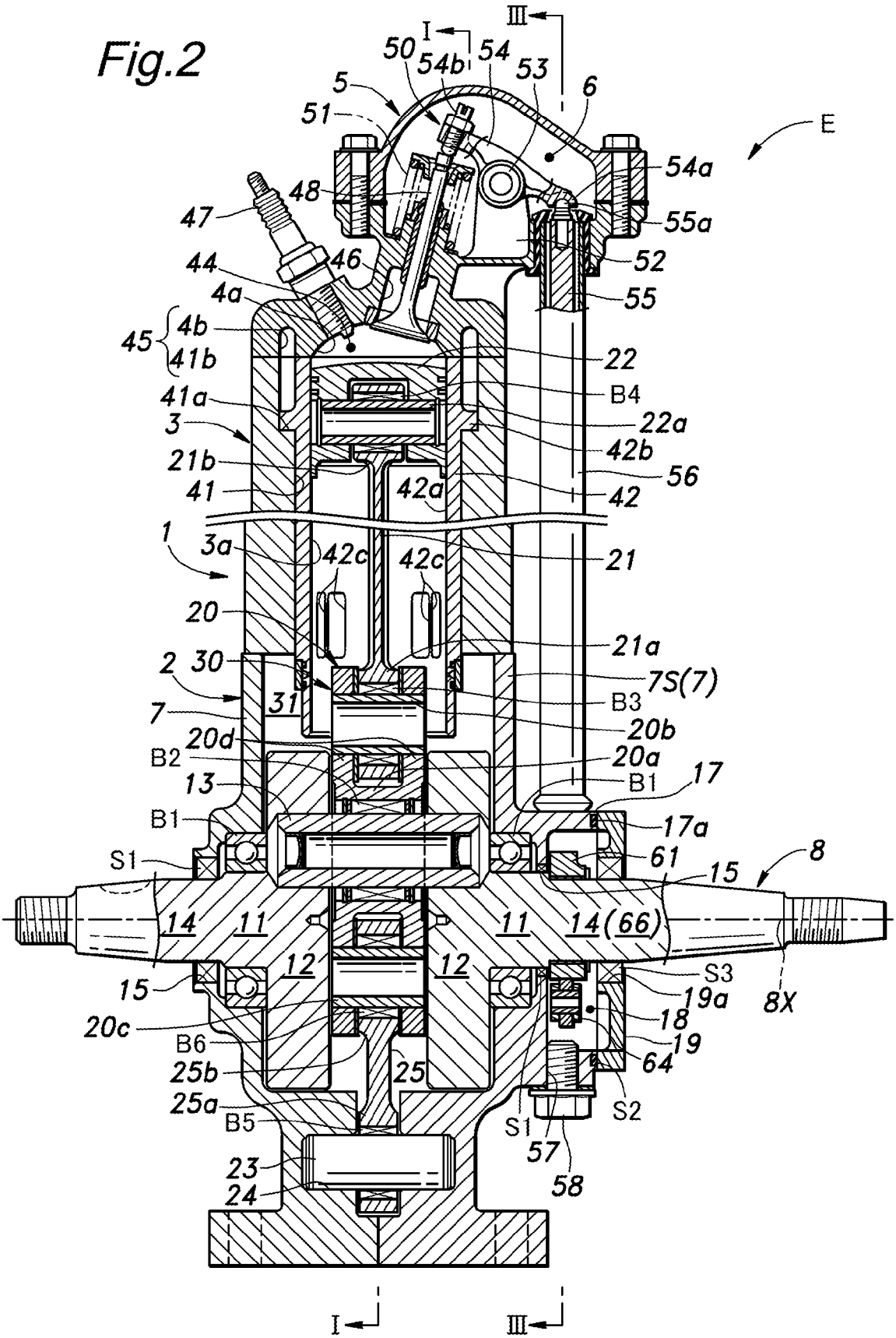
FIG. 2 is a sectional view taken along line II-II of FIG. 1.

Referring to FIGS. 1 and 2, an engine main body 1 of the engine E is provided with a crankcase 2 defining a crank chamber 2*a* therein, a cylinder block 3 connected to the upper end of the crankcase 2 and defining a cylinder bore 3*a* therein, a cylinder head 4 connected to the upper end of the cylinder block 3 and a head cover 5 attached to the upper end of the cylinder head 4 to define an upper valve chamber 6 in cooperation with the cylinder head 4.

The lower most part of the crankcase 2 is provided with an opening 2*b* which conducts the lubricating oil that collects in the bottom part of the crank chamber 2*a* to an oil tank 71 provided outside of the engine main body 1. An oil pump 72 provided in conjunction with the oil tank 71 supplies the lubricating oil in the oil tank 71 to the sliding part between the piston and the cylinder. The oil tank 71 and the oil pump 72 form a part of a cylinder lubrication system 70 for lubricating the sliding part between the piston and the cylinder. The oil pump 72 may be actuated either by the crankshaft 8 or by an external power source such as an electric motor.

Figure 3:
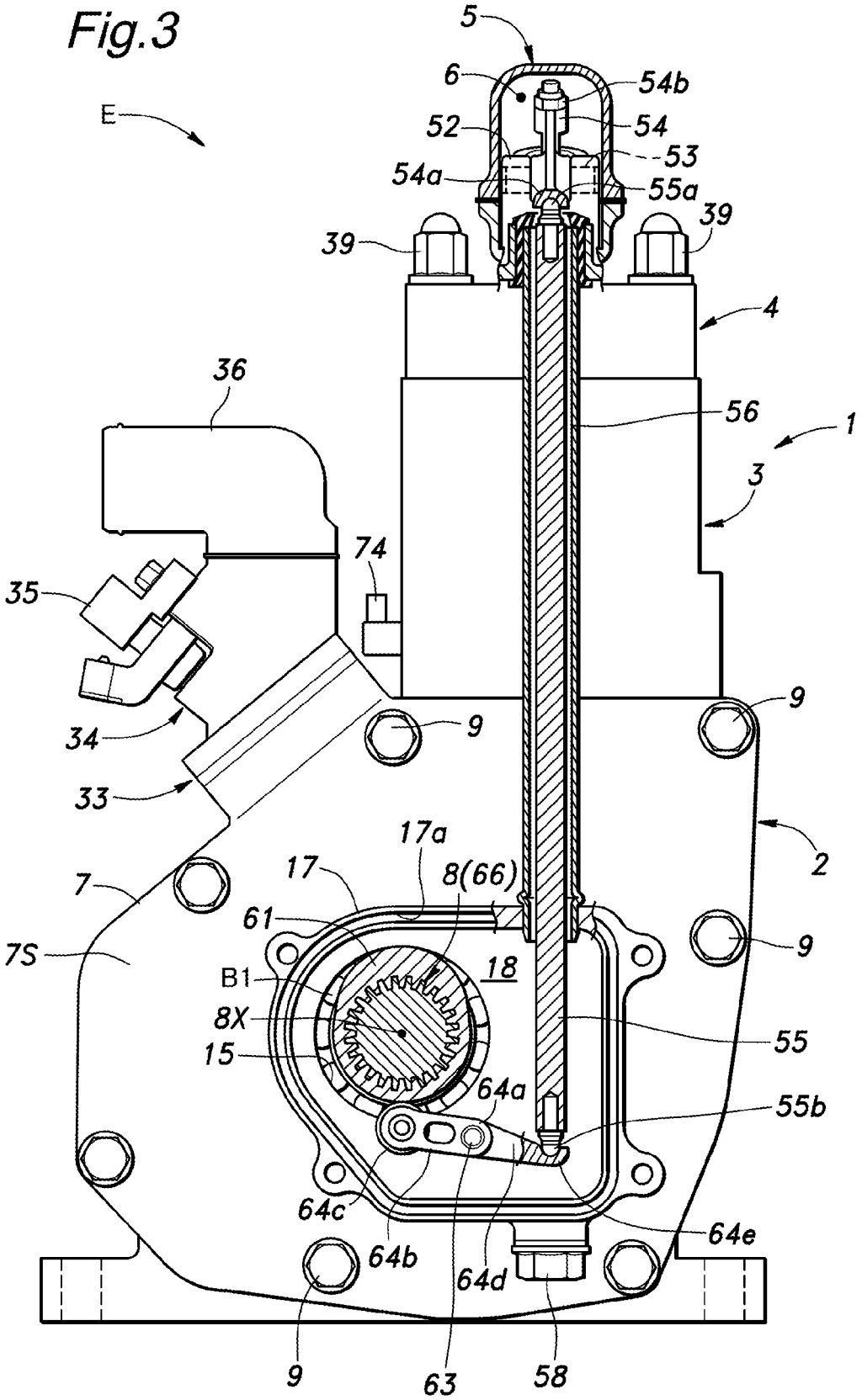
FIG. 3 is a sectional view taken along line III-III of FIG. 2.

As best shown in FIG. 2, the crankcase 2 consists of two crankcase halves 7 having a parting plane extending perpendicularly to the crankshaft axial line 8X and joined to each other by seven threaded bolts 9 (FIGS. 1 and 3). Each crankcase half 7 includes a side wall 7S which is provided with an opening through which the corresponding end of a crankshaft 8 projects, and the corresponding end of the crankshaft 8 is rotatably supported by the side wall 7S via a first bearing B1. Thus, the crankshaft 8 is rotatably supported at two ends thereof by the crankcase 2, and has a crank throw received in the crank chamber 2*a* defined by the crankcase 2.

The crankshaft 8 includes a pair of journals 11 that are rotatively supported by the first bearings B1, respectively, a pair of crank webs 12 extending radially from middle parts of the crankshaft 8, a crankpin 13 extending between the two webs 12 radially offset from and in parallel with the axial line 8X of the crankshaft 8, and a pair of extensions 14 extending coaxially from the outer ends of the journals 11 out of the crankcase 2. Each crank web 12 is formed as a circular disk defining a larger radius than the outer profile of the crankpin 13 so as to serve as a flywheel that stabilizes the rotation of the crankshaft 8 without substantially splashing the lubricating oil in the crank chamber 2*a*.

Each extension 14 of the crankshaft 8 extends out of the crankcase 2 via a through hole 15 formed in the side wall 7S of the corresponding crankcase half 7. The outer side of each ball bearing B1 is fitted with a seal S1 to ensure an air tight seal of the crank chamber 2*a*. As shown in FIGS. 2 and 3, the side wall 7S of the right crankcase half 7 is integrally formed with a lower valve case 17 protruding therefrom so as to surround the right extension 14 of the crankshaft 8 as seen in FIG. 2.

The lower valve case 17 is cylindrical in shape with an open outer axial end, and internally defines a lower valve chamber 18. The opening of the outer end of the lower valve case 17 is closed by a valve chamber lid 19. The outer axial end of the lower valve case 17 is provided with an annular seal groove 17*a* so that the valve chamber lid 19 may be joined to the opening of the lower valve case 17 in an air tight manner via a second seal member S2 received in the seal groove 17*a*.

The right end of the crankshaft 8 as seen in FIG. 2 is passed through a through hole 19*a* formed in the valve chamber lid 19, and extends further outward. The inner circumference of the through hole 19*a* is provided with a third seal member S3 for ensuring the airtight condition of the lower valve case 17, and hence the airtight condition of the crank chamber 2*a*.

As shown in FIG. 1, the central axial line 8X of the crankshaft 8 or the axial center of the journals 11 is offset from the cylinder axial line 3X to a side (left side in FIG. 1). The crankpin 13 rotates around the central axial line 8X of the crankshaft 8 as the crankshaft 8 rotates, and rotatably supports a middle point of a trigonal link 20 via a tubular portion 20*a* of the trigonal link 20. A second bearing B2 is interposed between the crankpin 13 and the tubular portion 20*a*.

The trigonal link 20 includes a pair of plates 20*d* that are joined by the tubular portion 20*a* in a mutually parallel relationship, and a pair of connecting pins (a first connecting pin 20*b* and a second connecting pin 20*c*) fixedly passed between the two plates 20*d*. These connecting pins 20*b* and 20*c* and the crankpin 13 form three pivot points that are arranged in a line at a substantially same interval with the crankpin 13 located in the middle.

The first connecting pin 20*b* located on the side of the cylinder axial line 3X is pivotally connected to a big end 21*a* of a connecting rod 21 via a third bearing B3. A small end 21*b* of the connecting rod 21 is pivotally connected to a piston 22 slidably received in the cylinder bore 3*a* via a piston pin 22*a* and a fourth bearing B4.

A pivot shaft 23 is fixedly provided in a lower part of the crankcase 2, on the side remote from the first connecting pin 20*b*. The rotational center lines of the pivot shaft 23 and the three pivot points (20*a*, 20*b* and 20*c*) are all in parallel to one another. As shown in FIG. 2, the pivot shaft 23 is press fitted into a pair of mutually opposing holes 24 formed in the two halves of the crankcase 2, respectively. A base end 25*a* of a swing link 25 is pivotally connected to the pivot shaft 23 via a fifth bearing B5. The swing link 25 extends substantially upward from the base end 25*a* thereof, and an upper end or a free end 25*b* of the swing link 25 is pivotally supported by the second connecting pin 20*c* (remote from the cylinder axial line 3X) via a sixth bearing B6.

The engine E is thus provided with a multiple link mechanism 30 which includes the trigonal link 20 and the swing link 25 in addition to the connecting rod 21. The multiple link mechanism 30 converts the linear reciprocating movement of the piston 22 into a rotational movement of the crankshaft 8. The dimensions and positions of the various components of the multiple link mechanism 30 are selected and arranged such that a prescribed compression ratio selected for the properties of the particular fuel may be achieved. The compression ratio is selected such that the pre-mixed mixture may self-ignite in an appropriate manner. The fuels that may be used for this engine include gasoline, diesel fuel, kerosene, gas (utility gas, LP gas and so on), etc.

Owing to the use of the multiple link mechanism 30, for the given size of the engine E, the piston stroke L can be maximized so that a larger part of the thermal energy can be converted into kinetic energy, and the thermal efficiency of the engine E can be improved. More specifically, as shown in part (A) of FIG. 4, when the piston 22 is at the top dead center, the big end 21*a* of the connecting rod 21 which is connected to the first connecting pin 20*b* at the right end of the trigonal link 20 is located higher than the crankpin 13 by a first distance D1. Furthermore, as shown in part (B) of FIG. 4, when the piston 22 is at the bottom dead center, the big end 21*a* of the connecting rod 21 is located lower than the crankpin 13 by a second distance D2. Therefore, as compared to the conventional engine where the big end 21*a* of the connecting rod 21 is directly connected to the crankpin 13, the piston stroke L can be extended by the sum of these two distances or by D1+D2. Therefore, the piston stroke L of the engine E can be extended without increasing the size of the crankcase 2 or the overall height of the engine E.

Figure 4:
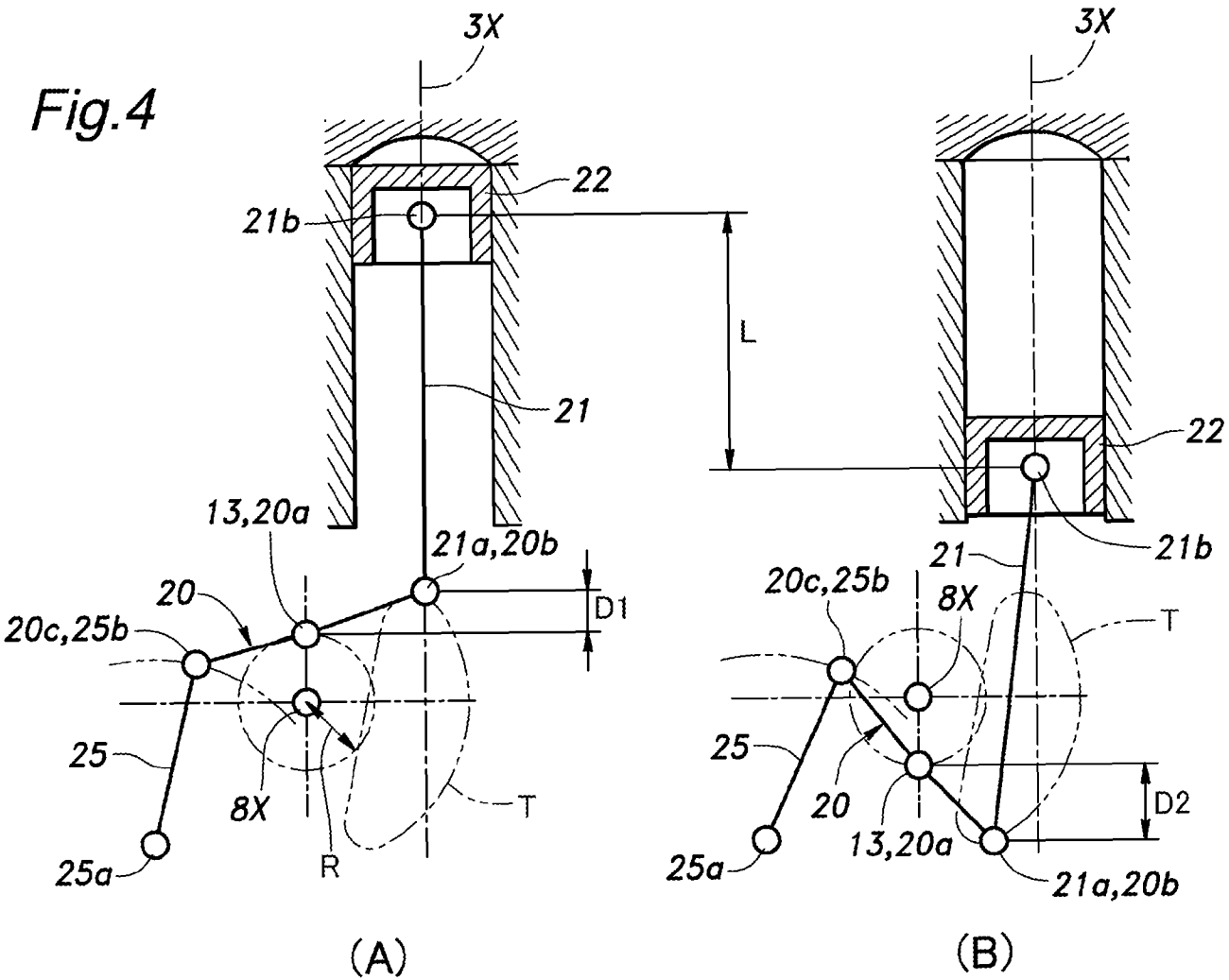
FIG. 4 is a diagram showing the mode of operation of a multiple linkage mechanism used in the engine.

In this engine E, the trajectory T of the big end 21*a* of the connecting rod 21 is vertically elongated, instead of being truly circular, as shown in (A) and (B) of FIG. 4. In other words, as compared to the more conventional reciprocating engine having the constant crank radius R, the swing angle of the connecting rod 21 is reduced. Therefore, the interferences between the lower end of the cylinder (or lower end of the cylinder sleeve 42) and the connecting rod 21 can be avoided even when the cylinder bore 3*a* is relatively small. Furthermore, the reduction in the swing angle of the connecting rod 21 contributes to the reduction in the thrust loads which the piston 22 applies to the two sides (thrust side and anti-thrust side) of the cylinder wall.

As shown in FIG. 1, the crank chamber 2*a* is laterally extended in the region of the swing link 25 and is vertically extended in the region directly under the piston 22 so that the trigonal link 20 that undergoes a composite rotational movement, the swing link 25 that undergoes a swinging movement and the connecting rod 21 that undergoes a vertically elongated circular movement may not interfere with one another. The part of the crankcase 2 adjoining the lower end of the cylinder bore 3*a* is formed with a cylindrical recess 31 having a circular cross section (taken along a horizontal plane) substantially coaxial with the cylinder bore 3*a* and surrounding the lower end of the cylinder sleeve 42 such that an annular space communicating with the crank chamber 2*a* is defined around the lower end of the cylinder sleeve 42. In FIG. 1, the piston 22 at the bottom dead center is indicated by imaginary lines.

The cylindrical recess 31 is provided with a greater inner diameter than the outer diameter of the lower part of the cylinder sleeve 42, and a retaining portion 2*c* formed in the crankcase 2 projects into an outer peripheral part of the cylindrical recess 31. The retaining portion 2*c* retains a first oil passage forming member 73 which defines an oil passage for supplying lubricating oil to the sliding part between the piston and the cylinder. Owing to the presence of the retaining portion 2*c*, a C-shaped space communicating with the crank chamber 2*a* is defined around the lower part of the cylinder sleeve 42. The first oil passage forming member 73 is provided with an oil passage 73*a* including an outlet that opens out at the inner circumferential surface of the cylinder sleeve 42 at a same position as an oil passage 75*a* of a third oil passage forming member 75 (which will be described hereinafter). The upstream end of the oil passage 73*a* of the first oil passage forming member 73 is connected to an oil passage 80 formed in the cylinder block 3. A second oil passage forming member 74 is fitted into a side wall of the cylinder block 3 to serve as a fluid coupling (internally defining an oil inlet passage) that conducts the oil supplied by the oil pump 72 into the oil passage 80 formed in the cylinder block 3. Thus, the lubricating oil feed by the oil pump 72 is introduced into the oil passage 80 formed in the cylinder block 3 via the oil inlet passage defined in the second oil passage forming member 74, and is then passed into the oil passage 73*a* of the first oil passage forming member 73 and the oil passage 75*a* of the third oil passage forming member 75.

An intake port 32 is formed by a tubular extension of the crankcase 2 extending obliquely upward adjacent to the first oil passage forming member 73 in the upper part of the crankcase 2. The intake port 32 is fitted with a reed valve 33 that permits the flow of air from the intake port 32 to the crank chamber 2*a*, and prohibits the flow of air in the opposite direction. The reed valve 33 includes a base member 33*a* consisting of a wedge shaped member having a pointed end directed inward and a pair of openings defined on either slanted sides thereof, a pair of valve elements 33*b* mounted on the base member 33*a* so as to cooperate with the openings thereof and a pair of stoppers 33*c* placed on the backsides of the valve elements 33*b* so as to limit the opening movement of the valve elements 33*b* within a prescribed limit. The reed valve 33 is normally closed, and opens when the piston 22 moves upward and the internal pressure in the crank chamber 2*a* thereby drops.

To the outer end of the intake port 32 is connected a throttle body 34 so as to define an intake passage 34*a* extending vertically as a smooth continuation of the intake port 32. A throttle valve 34*b* is pivotally mounted on a horizontal shaft for selectively closing and opening the intake passage 34*a*. A fuel injector 35 is also mounted on the throttle body 34 with an injection nozzle 35*a* thereof directed into a part of the intake passage 34*a* somewhat downstream of the throttle valve 34*b*. The axial line of the fuel injector 35 is disposed obliquely so as to be directed to the reed valve 33, and fuel is injected into the intake passage 34*a* in synchronism with the opening of the reed valve 33. The upstream end of the throttle body 34 is connected to an L shaped intake pipe 36 including a vertical section connected to the throttle body 34 and a horizontal section extending away from the cylinder block 3.

Four stud bolts 38 are secured to the upper side of the crankcase 2 and extend upward around the cylinder bore 3*a* at a regular interval as can be seen from FIG. 1. The cylinder block 3 and the cylinder head 4 are secured to the crankcase 2 by passing the stud bolts 38 therethrough and threading acorn nuts 39 onto the upper ends of the stud bolts 38.

As shown in FIGS. 1 and 2, the cylinder block 3 is provided with a bore 41 having a circular cross section passed therethrough, and the cylinder sleeve 42 is fitted into this bore 41 with the lower end thereof extending into the cylindrical recess 31 mentioned above. The bore 41 is provided with a large diameter section 41*b* in an upper end thereof defining an annular shoulder 41*a* facing upward, and the cylinder sleeve 42 is provided with a radial flange 42*b* configured to rest on this annular shoulder 41*a*. The upper end part of the cylinder sleeve 42 (or the part thereof located above the radial flange 42*b*) defines an annular space 41*b* in cooperation with the large diameter section 41*b* of the bore 41 of the cylinder block 3.

The cylinder sleeve 42 is provided with a constant inner diameter over the entire length thereof except for the lower end thereof which is chamfered, and the cylinder bore 3*a* is defined by an inner circumferential surface 42*a* of the cylinder sleeve 42. The outer diameter of the cylinder sleeve 42 is also constant over the entire length thereof except for the lower end thereof which is reduced in diameter over a certain length and a part adjacent to the upper end thereof which is provided with the radial flange 42*b* defining an annular shoulder surface abutting the annular shoulder 41*a* to determine the axial position of the cylinder sleeve 42 relative to the cylinder block 3. The upper end of the cylinder sleeve 42 is flush with the upper end surface of the cylinder block 3, and the cylinder sleeve 42 is provided with a somewhat greater vertical dimension than the cylinder block 3 so that the lower end of the cylinder sleeve 42 projects out of the lower end of the cylinder block 3 into the cylindrical recess 31 of the crankcase 2.

The front and rear sides of the lower part of the cylinder sleeve 42 is provided with three scavenging orifices 42*c* at the regular interval of 120 degrees each having an upper edge located somewhat higher than the interface between the cylinder block 3 and the crankcase 2. The three scavenging orifices 42*c* are identical in shape and dimensions, and are located at the same elevation. As shown in FIGS. 1 and 2, each scavenging orifice 42*c* consists of a pair of rectangular openings separated by a vertical bar and positioned laterally next to each other.

As shown in FIG. 1, the part of the cylinder block 3 opposing each scavenging orifice 42*c* is formed with a recess 3*b* defined by a curved wall surface which is configured to guide the mixture from the crank chamber 2*a* smoothly into the scavenging orifices 42*c*. In other words, each scavenging orifice 42*c* and the corresponding recess 3*b* jointly form a scavenging port 43 that communicates the crank chamber 2*a* and the cylinder bore 3*a* with each other via the cylindrical recess 31. In particular, each scavenging port 43 communicates the crank chamber 2*a* and the cylinder bore 3*a* (or the combustion chamber 44 thereof defined above the piston 22) via the cylindrical recess 31 during a late part of the downward stroke of the piston 22 and an early part of the upward stroke of the piston 22 so that the scavenging port is opened and closed by the piston 22 as the piston 22 moves up and down.

Figure 5:
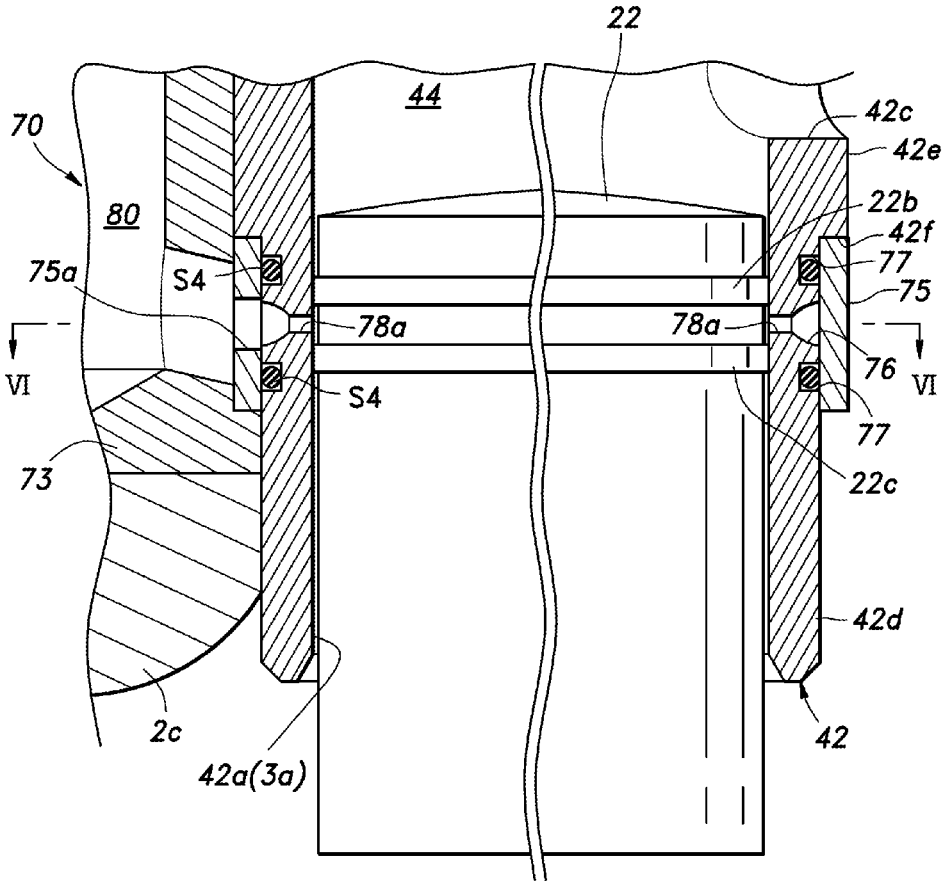
FIG. 5 is an enlarged fragmentary sectional view of a part indicated by V in FIG. 1.

The lower part of the cylinder sleeve 42 which projects into the cylindrical recess 31 and located below the scavenging orifices 42*c* is closely surrounded with the third oil passage forming member 75 consisting of an annular band. FIG. 5 is an enlarged view of the part indicated by V in FIG. 1 when the piston 22 is at the bottom dead center. As shown in FIG. 5, a pair of annular grooves are formed around the upper part of the piston 22 which receive a compression ring (top ring) 22*b* and an oil ring 22*c*, respectively. The third oil passage forming member 75 is fitted on a small diameter portion 42*d* in the lower end part of the cylinder sleeve 42 such that the upper surface of the third oil passage forming member 75 abuts an annular shoulder surface 42*f* defined between the small diameter portion 42*d* and the remaining part of the cylinder sleeve 42 (or a large diameter portion 42*e* thereof). The third oil passage forming member 75 is provided with a substantially same outer diameter as the large diameter portion 42*e* of the cylinder sleeve 42 so that the continuous outer circumferential surface is defined by these two members. The part of the third oil passage forming member 75 is formed with a through hole serving as an oil passage 75*a* corresponding to the oil passage 73*a* of the first oil passage forming member 73 which in turn communicates with the oil passage 80 formed in the cylinder block 3.

The outer circumferential surface of the small diameter portion 42*d* of the cylinder sleeve 42 is provided with an annular groove 76 at a height corresponding to the oil passage 75*a* of the third oil passage forming member 75. The annular groove 76 is closely surrounded by the third oil passage forming member 75 so as to define an annular oil passage. The outer circumferential surface of the small diameter portion 42*d* of the cylinder sleeve 42 is further provided with a pair of annular seal grooves 77, one above the annular groove 76 and the other below the annular groove 76, for receiving O-rings or fourth seal member S4 for sealing the annular groove 76 in cooperation with the third oil passage forming member 75. The cylinder sleeve 42 is formed with a number of oil supply holes 78 (78*a*-78*c*) that are located lower than the compression ring 22*b* and higher than the oil ring 22*c* when the piston 22 is at the bottom dead center, and communicates the annular groove 76 with the interior of the cylinder sleeve 42. The oil supply holes 78 extend horizontally and radially and open out in the interior of the cylinder sleeve 42 at the same height as the annular groove 76. The oil supply holes 78 and the various oil passages 73*a*, 75*a*, 80 jointly form a cylinder lubrication system 70 for lubricating the sliding part between the piston and the cylinder.

Figure 6:
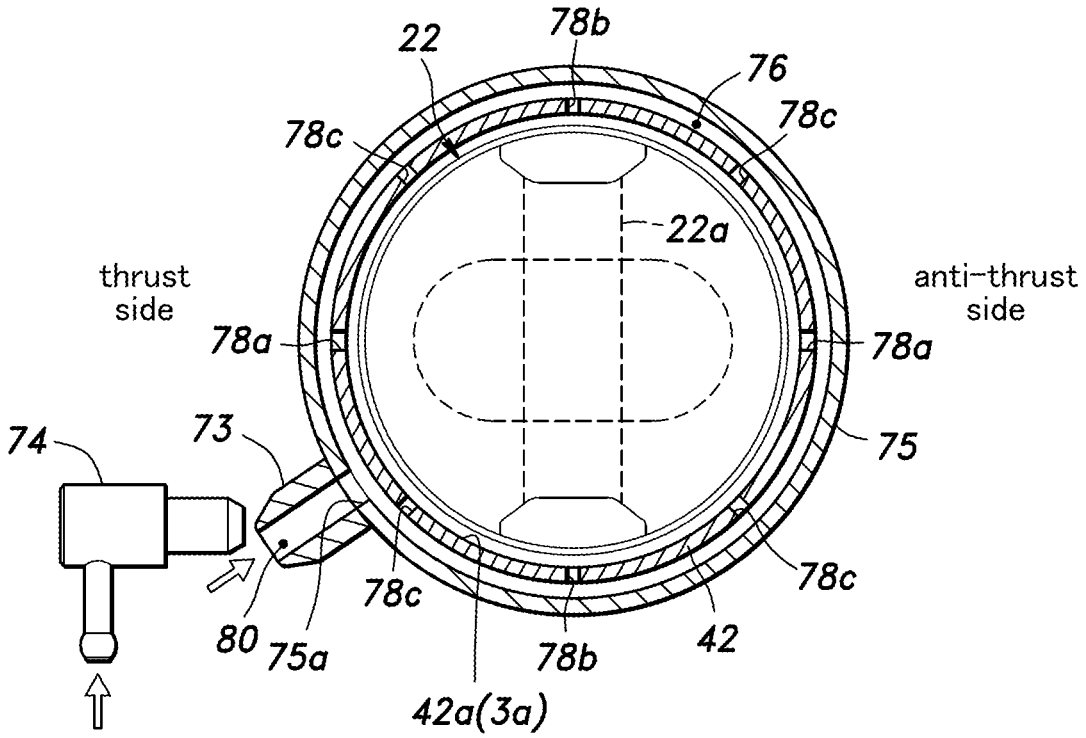
FIG. 6 is a horizontal sectional view taken along line VI-VI of FIG. 5.
Figure 7:
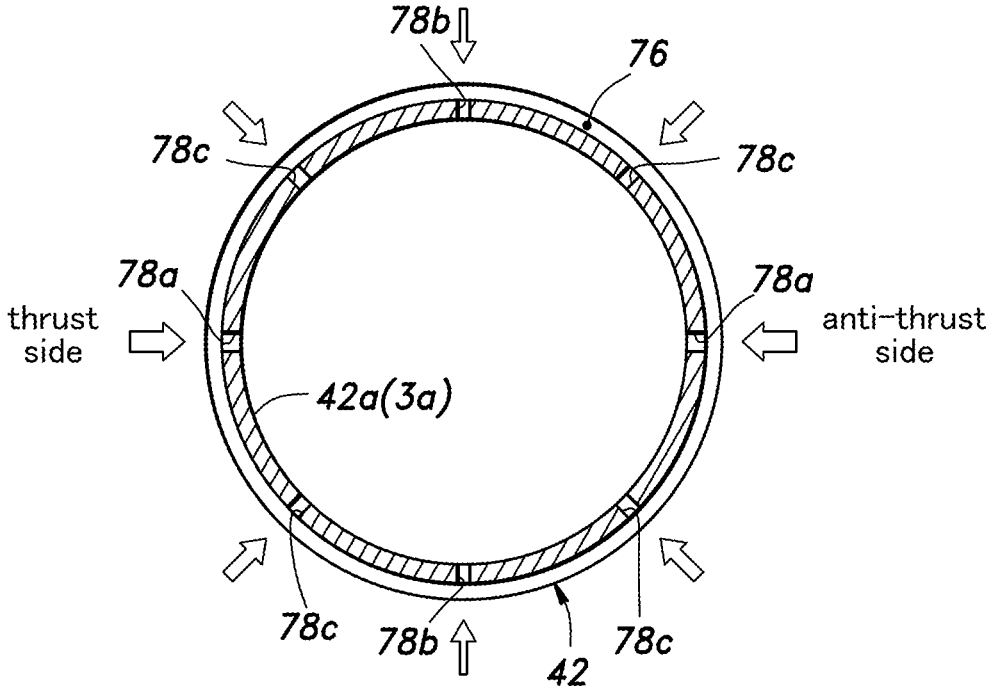
FIG. 7 is a horizontal section view showing the details of the oil supplying holes shown in FIG. 6.

As shown in FIG. 6, the oil passages 73*a* and 75*a* of the first and third oil passage forming members 73 and 75 are placed at a position offset or at an angle from the direction perpendicular to the piston pin 22*a* (the thrust/anti-thrust direction). On the other hand, the oil supply holes 78 are provided at eight locations at a circumferentially regular interval (45 degrees) including two of them that are located in the thrust/anti-thrust direction. In the illustrated embodiment, the oil passage 75*a* opens into the annular groove 76 at a point that does not align with any of the oil supply holes 78 to minimize any even distribution of the lubricating oil to the oil supply holes 78.

The two oil supply holes (first oil supply holes) 78*a* that are located in the thrust/anti-thrust direction have a diameter d1, the two oil supply holes (second oil supply holes) 78*b* that are located in the piston pin direction have a diameter d2, and the remaining four oil supply holes (third oil supply holes) 78*c* have a diameter d3, these diameters being dimensioned such that d1>d2>d3. In other words, those oil supply holes 78*a* located in the thrust/anti-thrust direction have a greater inner diameter than those of the other oil supply holes 78*b* and 78*c*.

Therefore, the lubricating oil supplied from the pump 72 is forwarded to the oil supply holes 78 via the oil passages 80, 73*a* and 75*a* and the annular groove 76. In particular, a relative large amount of oil is supplied to the cylinder bore 3*a* via each first lubricating oil supply holes 78*a* located in the thrust/anti-thrust direction, and a relatively small amount of oil is supplied to the cylinder bore 3*a* via each second lubricating oil supply holes 78*b*. An even smaller amount of oil is supplied to the cylinder bore 3*a* via each third lubricating oil supply holes 78*c*. The lubricating oil is deposited on the outer circumferential surface of the piston 22 when the piston 22 is near the bottom dead center thereof, and when the piston 22 has reached the bottom dead center thereof, the lubricating oil is deposited in the region of the outer circumferential surface of the piston 22 located between the compression ring 22*b* and the oil ring 22*c*. The lubricating oil that has deposited on the outer circumferential surface of the piston 22 is pulled upward in the cylinder bore 3*a* during the upward stroke of the piston 22, and provides a lubrication to the sliding part between the piston and the inner circumferential surface 42*a* of the cylinder sleeve 42. In particular, the lubricating oil that has deposited on the region of the outer circumferential surface of the piston 22 located between the compression ring 22*b* and the oil ring 22*c* is actively pulled upward by the scraping action of the oil ring 22*c*, and provides a favorable lubrication between the piston 22 and the cylinder sleeve 42 even when the piston 22 is near the top dead center thereof. The lubricating oil that has dropped under the gravitation force or scraped downward by the piston 22 is collected in the bottom part of the crank chamber 2*a*, and flows into the oil tank 71 via the opening 2*b* of the crankcase 2.

As shown in FIGS. 1 and 2, the part of the lower surface of the cylinder head 4 corresponding to the cylinder bore 3*a* is recessed in a dome-shape (dome-shaped recess 4*a*) so as to define a combustion chamber 44 jointly with the top surface of the piston 22. An annular groove 4*b* is formed in the lower surface of the cylinder head 4 concentrically around the dome-shaped recess 4*a* which aligns with the annular recess 41*b* defined between the upper part of the cylinder sleeve 42 and the surrounding wall of the cylinder block 3 such that a water jacket 45 surrounding the dome-shaped recess 4*a* of the cylinder head 4 and the upper part of the cylinder bore 3*a* is defined jointly by the annular recess 41*b* and the annular groove 4*b*.

The cylinder head 4 is further provided with an exhaust port 46 opening out at the top end of the combustion chamber 44 and a plug hole for receiving a spark plug 47 therein. In the illustrated embodiment, the spark plug 47 is normally activated only at the time of starting the engine to ignite the mixture in the combustion chamber 44. The exhaust port 46 is provided with an exhaust valve 48 consisting of a poppet valve to selectively close and open the exhaust port 46. The exhaust valve 48 includes a valve stem which is slidably guided by the cylinder head 4 at an angle to the cylinder axial line 3X, and the stem end of the exhaust valve 48 extends into the upper valve chamber 6 containing a part of the valve actuating mechanism 50 for actuating the exhaust valve 48 via the stem end thereof.

The valve actuating mechanism 50 includes a valve spring 51 that resiliently urges the exhaust valve 48 in the closing direction (upward), an upper rocker shaft 53 supported by a block 52 provided on the cylinder head 4 and an upper rocker arm 54 rotatably supported by the upper rocker shaft 53. The upper rocker shaft 53 extends substantially perpendicularly to the crankshaft 8, and the upper rocker arm 54 extends substantially in parallel to the crankshaft 8. One end of the upper rocker arm 54 is provided with a socket 54*a* engaging the upper end 55*a* of the pushrod 55, and the other end of the upper rocker arm 54 is provided with a tappet adjuster 54*b* consisting of the screw which engages the stem end of the exhaust valve 48. The upper end 55*a* of the pushrod 55 is given with a semi-spherical shape, and the socket 54*a* of the rocker arm 54 receives the upper end 55*a* of the pushrod 55 in a complementary manner, allowing a certain sliding movement between them.

As shown in FIGS. 2 and 3, the pushrod 55 extends substantially vertically along a side of the cylinder block 3, and is received in a tubular rod case 56 having an upper end connected to the cylinder head 4 and a lower end connected to the lower valve case 17. In the illustrated embodiment, the rod case 56 extends along the exterior of the cylinder block 3.

Because the crankshaft 8 is offset from the cylinder axial line 3X (FIG. 1), as best shown in FIG. 3, the lower end of the rod case 56 is connected to a part of the upper wall of the lower valve case 17 laterally offset from the crankshaft 8. The lower valve chamber 18 receives the remaining part of the valve actuating mechanism 50. The lower wall of the lower valve case 17 is provided with a drain hole 57 for expelling the lubricating oil in the lower valve chamber 18 which is usually closed by a drain plug 58.

The valve actuating mechanism 50 further comprises a cam 61 carried by the part of the crankshaft 8 extending into the lower valve chamber 18, a lower rocker shaft 63 supported by the side wall 7S of the crankcase 2 and the valve chamber lid 19 in parallel with the crankshaft 8 and a lower rocker arm 64 pivotally supported by the lower rocker shaft 63 for cooperation with the cam 61. In other words, one of the extensions 14 of the crankshaft 8 (the right end thereof in FIG. 2) serves as the camshaft 66 for the cam 61.

As shown in FIG. 3, the lower rocker arm 64 includes a tubular portion 64*a* rotatably supported by the lower rocker shaft 63, a first arm 64*b* extending from the tubular portion 64*a* toward the crankshaft 8, a roller 64*c* pivotally supported by the free end of the first arm 64*b* to make a rolling contact with the cam 61, a second arm 64*d* extending from the tubular portion 64*a* away from the first arm 64*b*, and a receiving portion 64*e* formed in the free end of the second arm 64*d* to support the lower end 55*b* of the pushrod 55. The lower end of the pushrod 55 is given with a semi-spherical shape, and the receiving portion 64*e* is formed as a recess complementary to the semi-spherical lower end of the pushrod 55 so as to receive the lower end of the pushrod 55 in a mutually slidable manner.

The engine E described above operates as described in the following at the time of start-up. Referring to FIG. 1, in the upward stroke of the piston 22, owing to the depressurization of the crank chamber 2*a*, the reed valve 33 opens. As a result, a mixture of the fresh air metered by the throttle valve 34*b* and the fuel injected into this fresh air by the fuel injector 35 is drawn into the crank chamber 2*a* via the reed valve 33 and the intake port 32. Meanwhile, the mixture in the cylinder bore 3*a* is compressed by the piston 22, and is ignited by the spark from the spark plug 47 when the piston 22 is near the top dead center.

The piston 22 then undergoes a downward stroke, and because the reed valve 33 is closed at this time, the mixture in the crank chamber 2*a* is prevented from flowing back to the throttle valve 34*b*, and compressed. During the downward stroke of the piston 22, before the piston 22 opens the scavenging port 43, the exhaust valve 48 actuated by the valve actuating mechanism 50 according to the cam profile of the cam 61 opens the exhaust port 46. Once the piston 22 opens the scavenging port 43, the compressed mixture is introduced into the cylinder bore 3*a* (combustion chamber 44) via the scavenging port 43. The combustion gas in the combustion chamber 44 is displaced by this mixture, and is expelled from the exhaust port 46 while part of the combustion gas remains in the combustion chamber 44 as EGR gas. The valve opening timing of the exhaust valve 48 is determined such that the amount of the EGR gas remaining in the combustion chamber 44 is great enough for the self-ignition of the mixture to take place owing to the rise in the temperature of the mixture in the combustion chamber 44 under compression with the increase in the amount of the EGR gas.

When the piston 22 undergoes an upward stroke once again, the piston 22 closes the scavenging port 43, and, thereafter, the exhaust valve 48 actuated by the first cam 61 closes the exhaust port 46. As a result, the mixture in the cylinder bore 3*a* (combustion chamber 44) is compressed while the crank chamber 2*a* is depressurized, causing the mixture to be drawn thereinto via the reed valve 33. Once the engine E is brought into a stable operation, the mixture is self-ignited as the piston 22 comes near the top dead center, and the combustion gas created by the resulting combustion pushes down the piston 22.

The engine E thus performs a two-stroke operation. In particular, spark ignition using the spark plug 47 is required at the time of start up, but once the engine starts operating in a stable manner, a two-stroke operation based on a homogeneous charge compression ignition is performed. The scavenging flow from the scavenging port 43 to the exhaust port 46 via the cylinder bore 3*a* is guided along a relatively straight path, or the so-called "uni-flow scavenging" can be achieved.

In the illustrated embodiment, the oil passage 80 connected to the oil pump 72 is formed in the cylinder block 3, and the oil supply holes 78 that communicate with the oil passage 80 and open out in the upper part of the cylinder bore 3*a* which is above the oil ring 22*c* and/or below the compression ring 22*b* are formed in the cylinder sleeve 42 when the piston 22 is at the bottom dead center so that the lubricating oil is favorably supplied to the sliding part between the piston 22 and the cylinder sleeve 42. Thus, the sliding resistance to the piston 22 is minimized, and the seizing of the piston 22 can be avoided in a reliable manner. Furthermore, such a lubrication can be accomplished by using a highly simple structure.

Particularly when the oil supply holes 78 open out in the upper part of the cylinder bore 3*a* which is above the oil ring 22*c* and/or below the compression ring 22*b* are formed in the cylinder sleeve 42 when the piston 22 is at the bottom dead center, the supplied lubricating oil is scraped upward by the oil ring 22*c* during the upward stroke of the piston 22 so that the lubrication of the sliding part between the piston 22 and the cylinder sleeve 42 when the piston 22 is near the top dead center can be performed in a highly favorable manner.

In the illustrated embodiment, because the thrust and anti-thrust sides of the cylinder bore 3*a* receive relatively large amounts of lubricating oil while the remaining parts receive relatively small amounts of lubricating oil, the parts involving greater frictions are favorably lubricated, and the parts involving smaller frictions are prevented from receiving excessive amounts of lubricating oil so that the use efficiency of lubricating oil can be optimized.

In the illustrated embodiment, as the oil supply holes 78 are arranged along the circumferential direction at a regular internal, and the diameter d1 of the first oil supply holes 78*a* located on the thrust and anti-thrust sides of the cylinder bore 3*a* is greater than the diameters d2 and d3 of the remaining oil supply holes 78*b* and 78*c*, relatively larger amounts of lubricating oil are supplied to the thrust and anti-thrust sides of the cylinder bore 3*a*. Thus, the thrust and anti-thrust sides of the cylinder bore 3*a* which are subjected to relatively high loadings are allowed to be preferentially lubricated simply by varying the sizes of the oil supply holes 78.

In the illustrated embodiment, the engine main body 1 comprises the cylinder block 3, the cylinder sleeve 42 fitted in the cylinder block 3 and having a lower end projecting from the cylinder block 3 into the crank chamber 2*a* and the annular third oil passage forming member 75 around the small diameter portion 42*d* of the cylinder sleeve 42 projecting into the crank chamber 2*a* such that the oil passage may be formed by the annular groove 76 formed around the small diameter portion 42*d* to distribute the lubricating oil supplied from the oil passage 80 defined in the cylinder block 3 to the lubricating oil supply holes 78 formed in the small diameter portion 42*d* of the cylinder sleeve 42.

Thereby, the oil passage for the distribution of lubricating oil can be fabricating in a highly simple manner. Because the annular third oil passage forming member 75 is fitted around the small diameter portion 42*d* of the cylinder sleeve 42 projecting into the crank chamber 2*a*, it is possible to assemble the third oil passage forming member 75 either before or after the third oil passage forming member 75 is installed in the cylinder block 3. In either case, the assembled state of the third oil passage forming member 75 can be inspected after the third oil passage forming member 75 is installed in the cylinder block 3.

The interface between the cylinder sleeve 42 and the third oil passage forming member 75 is sealed, both above and below, by the fourth seal members S4 received in the annular groove 76, and this provides a highly simple and reliable sealing performance.

Optionally, a one-way valve may be provided in the first oil passage forming member 73 of the second oil passage forming member 74 to prevent the mixture placed under pressure in the crank chamber 2*a* from flowing into the oil passages and blocking the supply of lubricating oil. It is also possible to provide a flow restricting orifice in any of these oil passage forming members to adjust the amount of lubricating oil to be supplied. A cut valve may be provided in any part of the oil passages to shut off the supply of lubricating oil when the engine is not in operation.

A second embodiment of the present invention is described in the following with reference to FIGS. 8 and 9. In the following description, the parts corresponding to those of the previous embodiment are denoted with like numerals without necessarily repeating the description of such parts.

Figure 8:
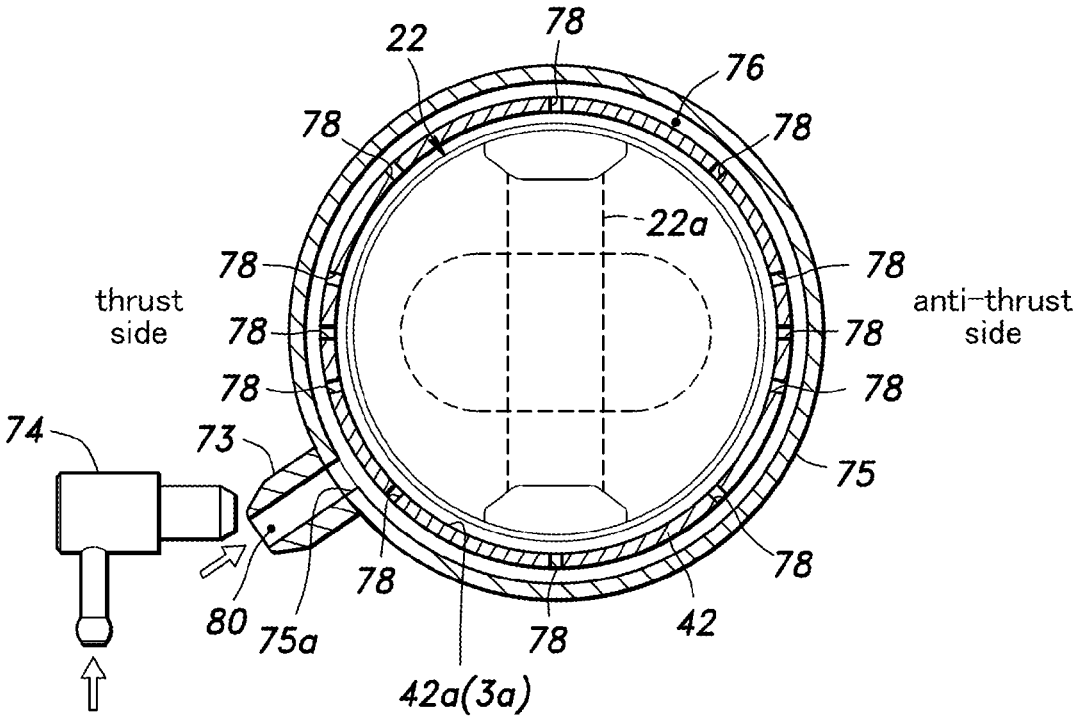
FIG. 8 is a view similar to FIG. 6 showing a second embodiment of the present invention.
Figure 9:
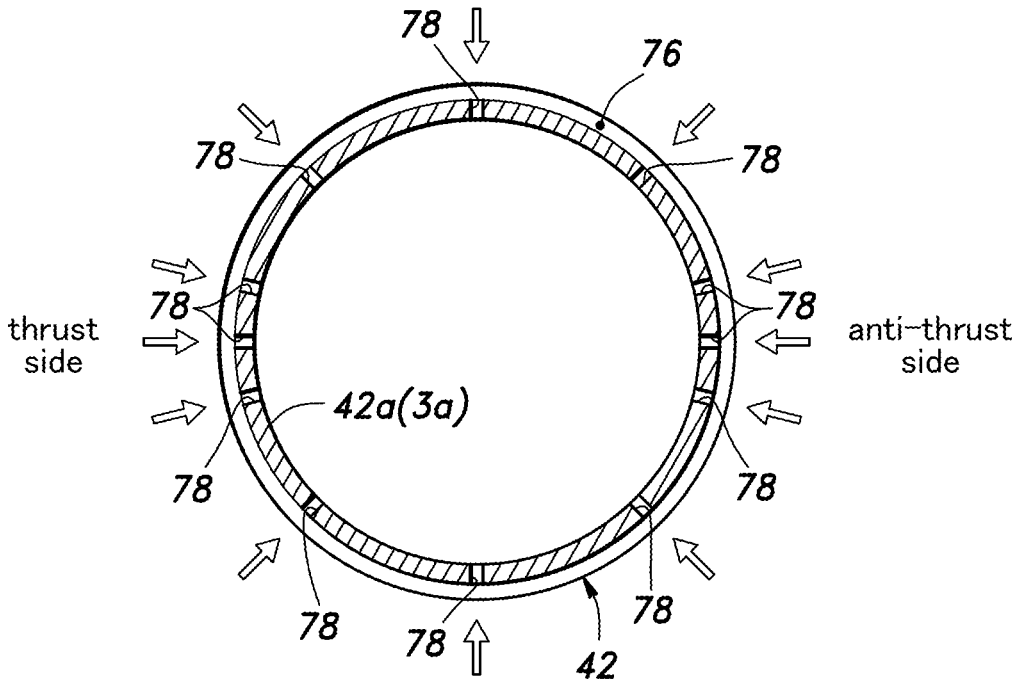
FIG. 9 is a view similar to FIG. 7 showing the second embodiment of the present invention.

As shown in FIGS. 8 and 9, there are twelve lubricating oil supply holes 78, and all of the lubricating oil supply holes 78 have a same diameter. In this case, the interval between the adjoining lubricating oil supply holes 78 is smaller in the thrust and anti-thrust sides of the cylinder bore 3*a* is smaller than that in the piston pin sides. In other words, the lubricating oil supply holes 78 are more densely provided in the thrust and anti-thrust sides of the cylinder bore 3*a* than in the piston pin sides. More specifically, three of the lubricating oil supply holes 78 are grouped in each of the thrust and anti-thrust sides at an interval of 15 degrees, and the remaining lubricating oil supply holes 78 are arranged at the regular interval of 45 degrees. Again, the oil passage 75*a* opens into the annular groove 76 at a point that does not align with any of the oil supply holes 78 to minimize any even distribution of the lubricating oil to the oil supply holes 78.

Therefore, a relative large amount of oil is supplied to the cylinder bore 3*a* via the first lubricating oil supply holes 78 located in the thrust/anti-thrust direction, and a relatively small amount of oil is supplied to the cylinder bore 3*a* via the remaining lubricating oil supply holes 78. The lubricating oil is deposited on the outer circumferential surface of the piston 22 when the piston 22 is near the bottom dead center thereof, and when the piston 22 has reached the bottom dead center thereof, the lubricating oil is deposited in the region of the outer circumferential surface of the piston 22 located between the compression ring 22*b* and the oil ring 22*c*. The lubricating oil that has deposited on the outer circumferential surface of the piston 22 is pulled upward in the cylinder bore 3*a* during the upward stroke of the piston 22, and provides a favorable lubrication to the sliding part between the piston and the inner circumferential surface 42*a* of the cylinder sleeve 42.

Thus, according to the second embodiment of the present invention, because the lubricating oil supply holes 78 are more densely provided in the thrust and anti-thrust sides of the cylinder bore 3*a* than in the piston pin sides, the thrust and anti-thrust sides are more preferentially lubricated. This embodiment is advantageous simplifying the manufacturing process because the lubricating oil supply holes 78 may have a same diameter.

A third embodiment of the present invention is described in the following with reference to FIG. 10. In the following description, the parts corresponding to those of the previous embodiments are denoted with like numerals without necessarily repeating the description of such parts.

Figure 10:
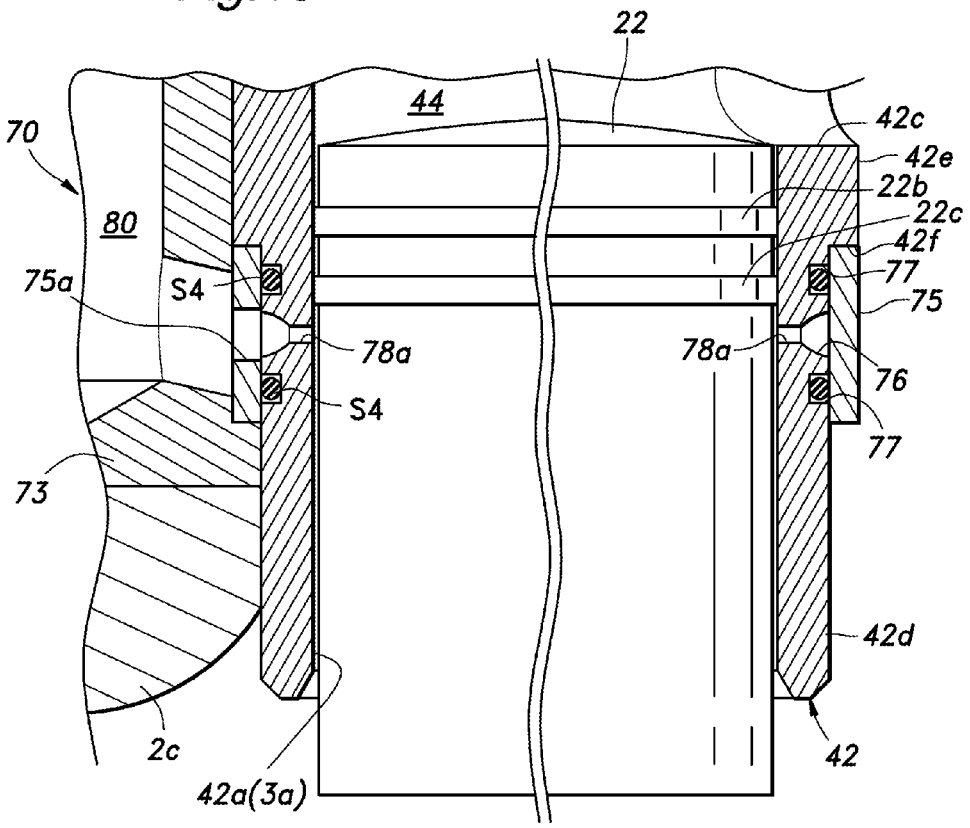
FIG. 10 is a view similar to FIG. 5 showing a third embodiment of the present invention.

FIG. 10 is a view similar to FIG. 5 showing an essential part of the engine E when the piston is at the bottom dead center. In this embodiment, the annular groove 76 and the lubricating oil supply holes 78 are provided immediately below the oil ring 22*c* or the lower most ring when the piston 22 is at the bottom dead center. In this case also, the lubricating oil that has deposited on the outer circumferential surface of the piston 22 during the downward stroke thereof is pulled upward as the piston 22 moves upward so that the interface between the outer circumferential surface of the piston 22 and the inner circumferential surface of the cylinder sleeve can be lubricated in a favorable manner during the entire stroke of the piston 22.

In the illustrated embodiments, the present invention was applied to an OHV, uni-flow type, two-stroke engine where the exhaust valve 48 is provided in the cylinder head 4. However, the present invention is equally applicable to more common two-stroke engines where the exhaust port opens out in the inner circumferential surface of the cylinder sleeve 42, instead of the exhaust valve 48 in the cylinder head 4. in the foregoing embodiments, the lubricating oil recovered from the crank chamber 2*a* was stored in the oil tank 71, and fed to the cylinder sleeve 42 by the oil pump 72. However, it is also possible to use a lubrication oil supply system for feeding lubricating oil to the valve actuating mechanism 50 for supplying lubricating oil to the cylinder sleeve. The annular groove 76 and the seal grooves 77 were formed in the outer circumferential surface of the cylinder sleeve 42, but may also be formed in the inner circumferential surface of the third oil passage forming member 75.

Although the present invention has been described in terms of preferred embodiments thereof, it is obvious to a person skilled in the art that various alterations and modifications are possible without departing from the scope of the present invention which is set forth in the appended claims.

The contents of the original Japanese patent application on which the Paris Convention priority claim is made for the present application as well as the contents of the prior art references mentioned in this application are incorporated in this application by reference.

The invention claimed is:

1. A cylinder lubrication system for a two-stroke engine including a scavenging port opening out in an inner circumferential surface of a cylinder, comprising:

a lubricating oil supply passage defined in an engine main body and connected to a lubricating oil source; and a plurality of lubricating oil supply openings opening out in the inner circumferential surface of the cylinder at a point lower than a top ring of a piston located at a bottom dead center, the piston being connected to a connecting rod by a piston pin;

wherein portions of the inner circumferential surface of the cylinder which are disposed on a line perpendicular to a longitudinal direction of the piston pin are a thrust side and an antithrust side of the inner circumferential surface of the cylinder, wherein the engine main body comprises a cylinder block and a cylinder sleeve fitted in the cylinder block, the lubricating oil supply openings being formed in the cylinder sleeve and an annular oil passage that communicates the lubricating oil supply passage with the plurality of lubricating oil supply openings being defined on an outer circumferential surface of the cylinder sleeve, wherein the lubricating oil supply openings are arranged circumferentially, wherein, at at least one axial position of the cylinder, the lubricating oil supply openings located nearest to the thrust side and the anti-thrust side are greater in diameter than the lubricating oil supply openings located nearest to portions of the inner circumferential surface of the cylinder which are disposed on a line extending in the longitudinal direction of the piston pin, wherein the cylinder sleeve includes a lower end projecting from the cylinder block into a crank chamber, the lubricating oil supply openings being formed in the lower end of the cylinder sleeve projecting from the cylinder block into the crank chamber; and wherein an annular oil passage forming member surrounds a part of the outer circumferential surface of the cylinder sleeve corresponding to the lubricating oil supply openings, and an annular groove serving as the annular oil passage is formed between an inner circumferential surface of the oil passage forming member and the outer circumferential surface of the cylinder sleeve so as to commonly communicate with the lubricating oil supply openings.

2. The cylinder lubrication system for a two-stroke engine according to claim 1, wherein the lubricating oil supply openings open out in the inner circumferential surface of the cylinder at a point higher than an oil ring of the piston located at a bottom dead center.

3. A cylinder lubrication system for a two-stroke engine including a scavenging port opening out in an inner circumferential surface of a cylinder, comprising:

a lubricating oil supply passage defined in an engine main body and connected to a lubricating oil source; and a plurality of lubricating oil supply openings opening out in the inner circumferential surface of the cylinder at a point lower than a top ring of a piston located at a bottom dead center, the piston being connected to a connecting rod by a piston pin;

wherein portions of the inner circumferential surface of the cylinder which are disposed on a line perpendicular to a longitudinal direction of the piston pin are a thrust side and an antithrust side of the inner circumferential surface of the cylinder, wherein the engine main body comprises a cylinder block and a cylinder sleeve fitted in the cylinder block, the lubricating oil supply openings being formed in the cylinder sleeve and an annular oil passage that communicates the lubricating oil supply passage with the lubricating oil supply openings being defined on an outer circumferential surface of the cylinder sleeve, wherein the lubricating oil supply openings are arranged circumferentially and are provided with a same diameter, wherein, at at least one axial position of the cylinder, the lubricating oil supply openings located nearest to the thrust side and the anti-thrust side are arranged at a higher density than the lubricating oil supply openings located nearest to portions of the inner circumferential surface of the cylinder which are disposed on a line extending in the longitudinal direction of the piston pin, wherein the cylinder sleeve includes a lower end projecting from the cylinder block into a crank chamber, the lubricating oil supply openings being formed in the lower end of the cylinder sleeve projecting from the cylinder block into the crank chamber; and wherein an annular oil passage forming member surrounds a part of the outer circumferential surface of the cylinder sleeve corresponding to the lubricating oil supply openings, and an annular groove serving as the annular oil passage is formed between an inner circumferential surface of the oil passage forming member and the outer circumferential surface of the cylinder sleeve so as to commonly communicate with the lubricating oil supply openings.

4. The cylinder lubrication system for a two-stroke engine according to claim 1, wherein an interface between the annular oil passage forming member and the cylinder sleeve is sealed by seal members, both above and below the annular groove.

5. The cylinder lubrication system for a two-stroke engine according to claim 3, wherein the lubricating oil supply openings open out in the inner circumferential surface of the cylinder at a point higher than an oil ring of the piston located at a bottom dead center.

6. The cylinder lubrication system for a two-stroke engine according to claim 3, wherein an interface between the annular oil passage forming member and the cylinder sleeve is sealed by seal members, both above and below the annular groove.

7. A cylinder lubrication system for a two-stroke engine including a scavenging port opening out in an inner circumferential surface of a cylinder, comprising:

a lubricating oil supply passage defined in an engine main body and connected to a lubricating oil source; and a plurality of lubricating oil supply openings opening out in the inner circumferential surface of the cylinder at a point lower than a top ring of a piston located at a bottom dead center, the piston being connected to a connecting rod by a piston pin;

wherein the engine main body comprises a cylinder block and a cylinder sleeve fitted in the cylinder block, the lubricating oil supply openings being formed in the cylinder sleeve and an annular oil passage that communicates the lubricating oil supply passage with the plurality of lubricating oil supply openings being defined on an outer circumferential surface of the cylinder sleeve, wherein the lubricating oil supply openings are arranged circumferentially, wherein the cylinder sleeve includes a lower end projecting from the cylinder block into a crank chamber, the lubricating oil supply openings being formed in the lower end of the cylinder sleeve projecting from the cylinder block into the crank chamber, and wherein an annular oil passage forming member surrounds a part of the outer circumferential surface of the cylinder sleeve corresponding to the lubricating oil supply openings, and an annular groove serving as the annular oil passage is formed between an inner circumferential surface of the oil passage forming member and the outer circumferential surface of the cylinder sleeve so as to commonly communicate with the lubricating oil supply openings.

* * * * *